US005821835A

United States Patent [19]

Hino

[11] Patent Number: 5,821,835

[45] Date of Patent: Oct. 13, 1998

[54] DIELECTRIC FILTER AND METHOD OF REGULATING ITS FREQUENCY BANDWIDTH

[75] Inventor: Seigo Hino, Nagoya, Japan

[73] Assignee: NGK Spark Plug Co., Ltd., Aichi-Ken, Japan

[21] Appl. No.: 618,204

[22] Filed: Mar. 19, 1996

[30] Foreign Application Priority Data

Mar. 23, 1995 [JP] Japan ..... 7-091567
Feb. 15, 1996 [JP] Japan ..... 8-054266

[51] Int. Cl.[6] ..... H01P 1/202

[52] U.S. Cl. ..... 333/202; 333/206; 333/207

[58] Field of Search ..... 333/203, 206, 333/207, 202, 202 DB

[56] References Cited

U.S. PATENT DOCUMENTS 5,124,676 6/1992 Ueno ..... 333/206
5,602,518 2/1997 Clifford, Jr. et al. ..... 333/202

FOREIGN PATENT DOCUMENTS 6164706 5/1986 Japan .

*Primary Examiner*—Benny Lee
*Attorney, Agent, or Firm*—Larson & Taylor

[57] ABSTRACT

A dielectric filter comprising a dielectric ceramic block in which two or more than two through bores are provided in parallel with each other so that they extend from a first end surface to a second end surface of the block. Each through bore has an inner surface covered with an electrically conductive layer. Auxiliary through bores are provided which extend from the associated one of the through bores to one of four lateral side surfaces of the block. Each auxiliary through bore has an inner surface covered with an electrically conductive layer and an opening at the respective one lateral side surface which is surrounded by an electrically non-conductive section. An electrically non-conductive connecting section is provided for connecting the electrically non-conductive sections, thereby providing a large bandwidth. There is also provided a method of regulating the frequency bandwidth of a dielectric filter in order to achieve a large bandwidth.

6 Claims, 8 Drawing Sheets

DIELECTRIC FILTER AND METHOD OF REGULATING ITS FREQUENCY BANDWIDTH

BACKGROUND OF THE INVENTION

1. Technical Field

The present invention relates to a dielectric filter comprising a plurality of resonators and a method of regulating the frequency bandwidth of such a filter.

2. Related Art

There have been proposed a variety of dielectric filters each comprising a dielectric ceramic block of a rectangularly parallelepipedic shape in which two or more through bores are formed in parallel with each other, the inner surface of each of the through bores is covered with an internal conductive film or layer operating as a resonant conductor, one of the oppositely disposed end surfaces of the dielectric ceramic block at which the openings of the through bores are positioned is devoid of a shield electrode to form an open-circuit end surface, and the other end surface of the dielectric ceramic block is provided with a shield electrode to form a short-circuit end surface along with the remaining four lateral side surfaces of the dielectric ceramic block. With a dielectric filter having such an arrangement, each of the resonant conductors operates as a resonator.

Dielectric ceramic blocks having a rectangularly parallelepipedic shape as described above normally show a dielectric constant that can vary from block to block so that their resonance frequencies have to be regulated by some means or other in order to produce dielectric filters with a same and identical resonance frequency. This regulating operation is typically carried out by partly and appropriately removing the internal conductive films of the resonant conductors from the open-circuit end surface of the block to reduce the effective length of the resonance conductors. On the other hand, the resonance length of a dielectric filter having such a configuration is automatically and substantially defined by the resonance frequency and the dielectric constant of the dielectric ceramic block and the latter does not permit adjustment once the resonance frequency and the dielectric constant are determined.

In an attempt to avoid the problem arising from the technique of removing the internal conductive films forming resonant conductors from the open-circuit end surface, there have been proposed dielectric filters including those disclosed in Japanese U.M.Kokai No. 61-64706 and Japanese Patent Kokai No. 3-6102. In one of the proposed dielectric filters, as illustrated in FIG. 1 of the accompanying drawings, it comprises a dielectric ceramic block A having a rectangularly parallelepipedic shape with two or more through bores B (three bores being provided in the drawing) formed in parallel with each other and provided with respective auxiliary through bores C (three bores being provided in the drawing) running perpendicularly from given positions of the through bores B to one lateral side surface of the dielectric ceramic block A. Each of the through bores B has an inner wall provided with an internal conductive film D and each of the auxiliary through bores C has an inner wall provided with an internal conductive film E which is connected to the internal conductive film D in the associated through bore B. The dielectric ceramic block A is provided with a shield electrode F on the outer surfaces except for one end surface or front end surface. Each of the openings of the auxiliary through bores C at the lateral side surface is provided with an electrically non-conductive section G disposed around it and formed by removing the shield electrode F there. The resonance frequency of a dielectric filter having such an arrangement can be regulated by appropriately removing the internal conductive films E from the openings of the auxiliary through bores C.

In a dielectric filter having such a configuration, the resonant conductors can be virtually connected in parallel with each other by way of the auxiliary through bores so that the capacitance of the resonators may be increased by the auxiliary through bores.

More specifically, referring to FIG. 2 of the accompanying drawings there is illustrated an equivalent circuit diagram of a dielectric filter of the type under consideration comprising three resonators θ1, θ2 and θ3. In FIG. 2, reference symbols L1 and L2 respectively denote inductances representing inductive couplings between the resonators θ1 and θ2 and between θ2 and θ3, while C1 and C2 respectively denote coupling capacitances.

The resonators θ1, θ2 and θ3 have a same capacitance of C3, respectively, and the auxiliary through bores respectively formed on them have the effect of connecting in parallel a capacitance of C4 to each capacitance C3. Since the resonance frequency Fo' is expressed by the general formula $F_o=\frac{1}{2}\pi(LC)^{1/2}$, wherein L is the total inductance and C is the total capacitance of the resonant circuit the auxiliary through bores increase the capacitance and decrease the resonance frequency $f_o$ of the resonators. In other words, the auxiliary through bores can reduce the resonance length of a dielectric filter having a fixed resonance frequency to consequently reduce the dimensions of the dielectric filter.

Meanwhile, there has been an increasing demand for dielectric filters having a large bandwidth, although those described above do not and cannot meet the demand unless a method of regulating the frequency bandwidth is known to realize a desired wide bandwidth.

It is, therefore, one object of this invention to provide a dielectric filter with a plurality of auxiliary through bores which has a large bandwidth.

Another object of the present invention is to provide a method of regulating the frequency bandwidth of a dielectric filter in order to achieve such a large bandwidth,

SUMMARY OF THE INVENTION

According to one aspect of the present invention, the above object is achieved by providing a dielectric filter comprising a dielectric ceramic block of a rectangularly parallelepipedic shape having a first and second end surfaces and four lateral side surfaces, said second end surface and four lateral side surfaces being substantially covered with a conductive layer which operates as a shield electrode;

at least two resonators disposed in parallel with each other within the dielectric ceramic block, each resonator comprising a through bore which extends from the first end surface to the second end surface of the dielectric ceramic block and an inner conductive layer provided on an inner surface of the through bore;

at least two auxiliary through bores each extending perpendicularly from a given position of the through bore of the associated resonator to one of the four lateral side surfaces and being provided with an inner conductive layer on an inner surface thereof, and each auxiliary through bore having an opening at the one lateral side surface of the block;

at least two electrically non-conductive sections each being arranged around the openings of each auxiliary through bore and being formed by removing the shield electrode portion on the one lateral side surface of the block surrounding the opening of each auxiliary through bore; and an electrically non-conductive connecting section provided for connecting the non-conductive sections to each other and formed by partly removing the shield electrode portion spreading between the adjacent openings of the auxiliary through bores.

Preferably, the electrically non-conductive connecting section may have a predetermined width and may extend along a straight line connecting the openings of the auxiliary through bores.

Alternatively, the connecting section may be provided to be extended along a straight line connecting the centers of the openings of the auxiliary through bores.

In the dielectric filter according to the present invention the auxiliary through bores may be located at positions separated from the first end surface by a distance equal to ¼ of a resonance length.

Also, the connecting section may comprise a slit or slits in the shield electrode portion spreading between the adjacent openings of the auxiliary through bores.

According to a second aspect of the present invention, there is provided a method of regulating the frequency bandwidth of a dielectric filter of the type under consideration by partly removing the shield electrode portion between the openings of the adjacent auxiliary through bores to form an electrically nonconductive connecting section for connecting the electrically non-conductive sections to each other, and setting a width of the electrically non-conductive connecting section so as to obtain a desired frequency bandwidth.

By a provision of the connecting section in a manner as described above, an attenuation pole that appears on the lower frequency side of the center frequency is shifted further on the lower frequency side to flatten the frequency characteristic at and near the center frequency to consequently broaden the frequency bandwidth.

Thus, the dielectric filter according to the present invention tends to exhibit a frequency bandwidth greater than that of a dielectric filter without such a connecting section. Additionally, a desired value can be selected for the frequency bandwidth by regulating the width of the connecting section.

More specifically, by removing the conductive layer or shield electrode portion between the openings of the auxiliary through bores on a lateral side or a top side surface of the dielectric ceramic block, the electric field in the dielectric filter is prevented from escaping to the shield electrode and consequently the intensity of electric field coupling is increased to establish a relationship that the electric field coupling is stronger than the magnetic field coupling in the dielectric filter so that the electric fields of any two adjacent resonators are effectively coupled. The intensity of the electric field coupling can then be regulated by the amount of the shield electrode to be removed and increases proportionally with the width of the connecting section. On the other hand, there exists a frequency that establishes a relationship that the strength of the electric field coupling is equal to that of the magnetic field coupling on the lower frequency side of the resonance frequency $f_o$ and an attenuation pole is formed at that frequency. Thus, the attenuation pole that establishes the above relationship is separated further away from the resonance frequency on the lower frequency side as the intensity of electric field coupling increases. As the attenuation pole moves away on the lower frequency side, the frequency characteristic having an apex at the resonance frequency $f_o$ is flattened to consequently broaden the frequency bandwidth of the dielectric filter.

Therefore, the frequency bandwidth can be increased by increasing the width of the connecting section and the frequency bandwidth can be regulated on the basis of the this relationship.

DETAILED DESCRIPTION OF THE PREFERRED EMBODIMENTS

Figure 1:
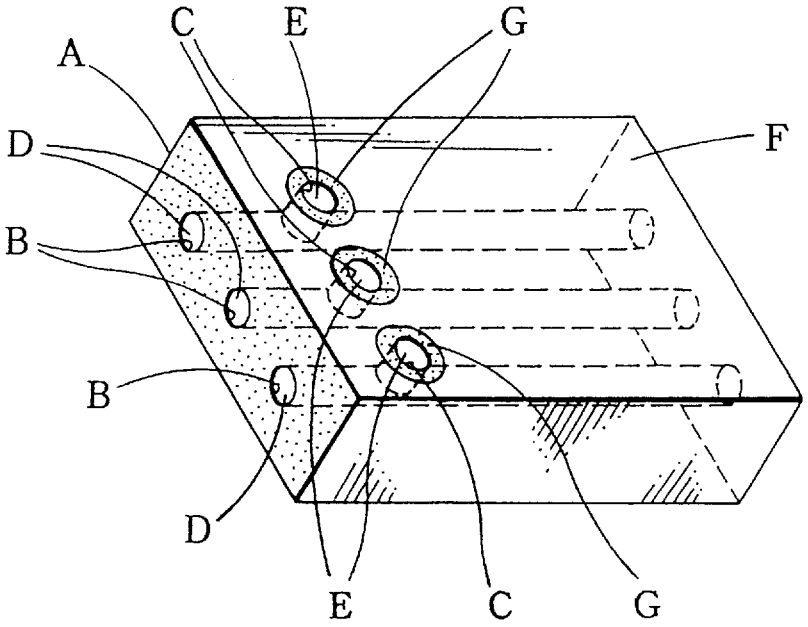
FIG. 1 PRIOR ART
FIG. 1 is a schematic perspective view of a known high frequency dielectric filter having no connecting section.
Figure 2:
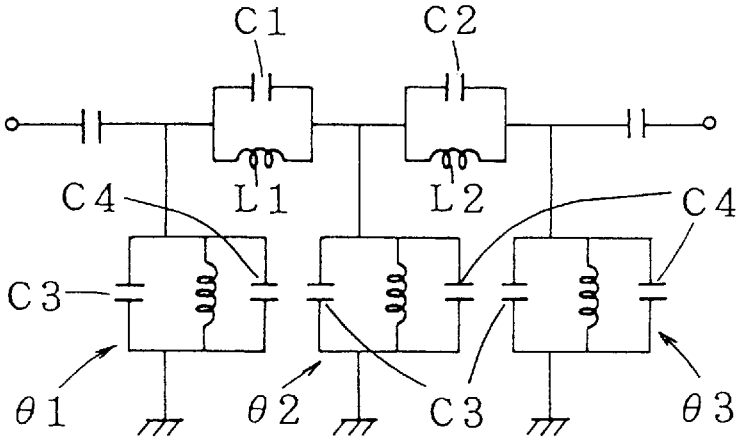
FIG. 2 PRIOR ART
FIG. 2 is an equivalent circuit diagram of a known dielectric filter with auxiliary through bores each of which has an inner conductive film on the inner surface.

FIGS. 4 through 7 illustrate a triple-resonator high frequency dielectric filter 1 comprising a single dielectric ceramic block 2 that is rectangularly parallelepipedic and provided with three resonators 3*a,* 3*b* and 3*c* (see FIG. 1).

Figure 4:
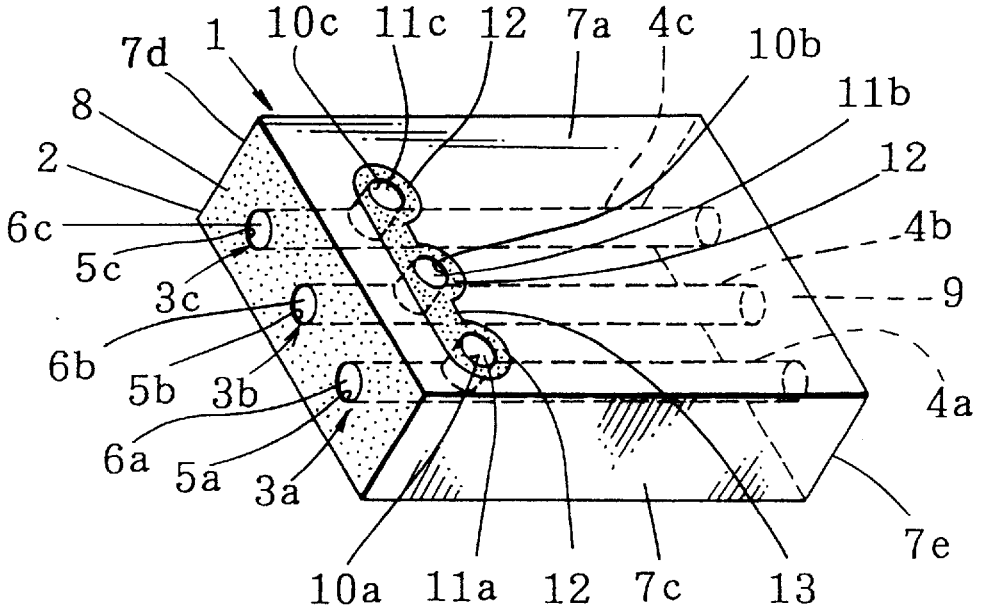
FIG. 4 is a schematic perspective view of a triple-resonator type high frequency dielectric filter according to the invention seen from above.
Figure 5:
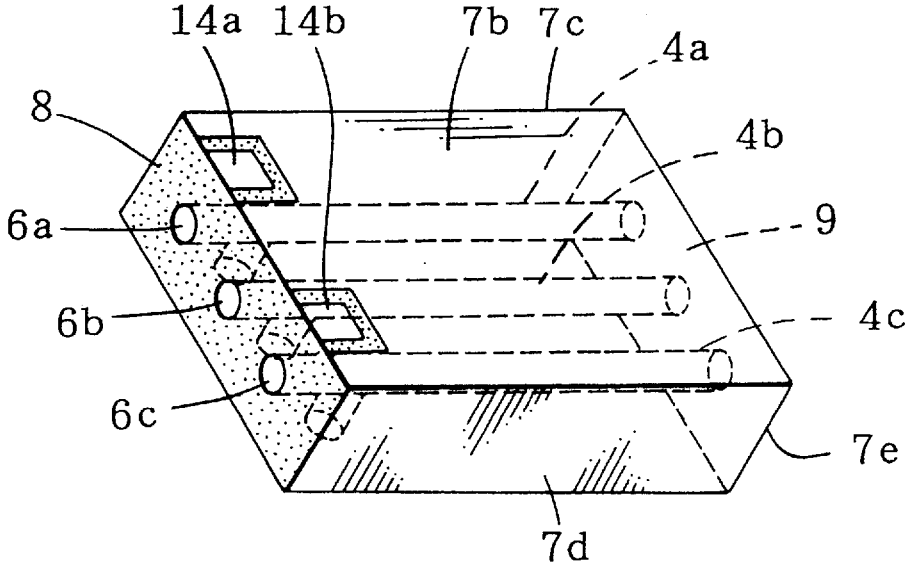
FIG. 5 is a schematic perspective view of the dielectric filter of FIG. 4 seen from below.

The dielectric ceramic block 2 is made of titanium oxide and has a rectangularly parallelepipedic profile. The three resonators 3*a,* 3*b* and 3*c* are respectively realized by arranging first, second and third resonant conductors 4*a,* 4*b* and 4*c* (FIGS. 4 and 5) in parallel with each other along a same direction. The resonant conductors 4*a,* 4*b* and 4*c* are formed by providing three through bores 5*a* 5*b* and 5*c* (FIG. 4) in the dielectric ceramic block 2 so that they extend from one end surface or a front end surface to the opposite end surface or rear end surface of the block 2 in parallel with each other and applying respective internal conductive films or layers 6*a,* 6*b* and 6*c* (FIGS. 4 and 5) on the inner surfaces of the through bores 5*a* 5*b* and 5*c*. The four lateral side surfaces and the rear end surface of the dielectric ceramic block 2 are coated with respective shield electrodes or grounding conductors 7*a,* (FIGS. 4, 6 and 7) 7*b,* (FIGS. 5 and 7) 7*c* (FIGS. 4 and 5) 7*d,* (FIGS. 4 and 5) and 7*e* (FIGS. 4, 5 and 7). The front end surface of the dielectric ceramic block 2 having openings of the resonant conductors 4*a,* 4*b* and 4*c* is devoid of such a shield electrode to form an open-circuit end surface 8, while the shield electrode 7*e* provided on the rear end surface is electrically connected to the internal conductive films 6*a,* 6*b* and 6*c* of the resonators 3*a,* 3*b* and 3*c,* respectively, and thus the rear end surface forms a short-circuit end surface 9. The resonant conductors 4*a,* 4*b* and 4*c* have a same and identical resonance length of ¼.

The dielectric ceramic block 2 is provided with three auxiliary through bores 10*a,* 10*b* and 10*c* (FIGS. 4 and 6) at positions close to the open-circuit end surface 8 so that they extend perpendicularly from the lateral side or top side surface of the dielectric ceramic block 2 provided with the shield electrode 7*a* to the respective through bores 5*a,* 5*b* and 5*c*. The auxiliary through bores 10*a,* 10*b* and 10*c* are covered on the internal surfaces thereof by internal conductive films or layers 11*a,* 11*b* and 11*c,* (FIGS. 4 and 6) respectively, which are connected to the respective conductive films 6*a,* 6*b* and 6*c* of the resonators 3*a,* 3*b* and 3*c* as shown in FIG. 7.

Figure 6:
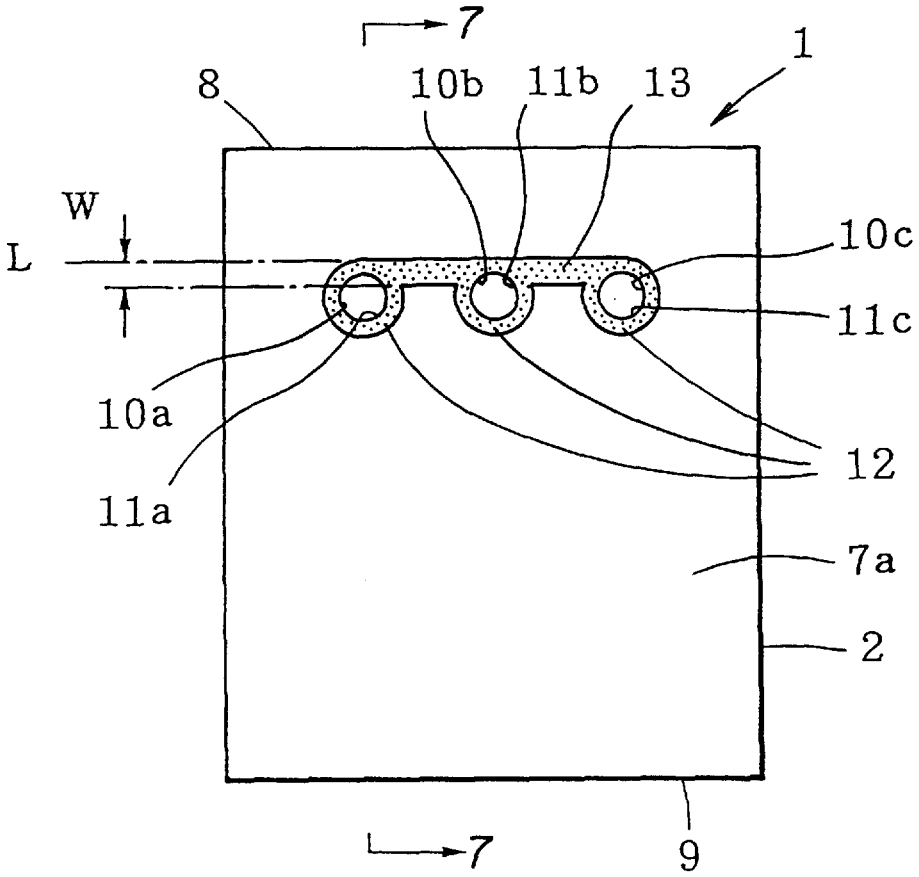
FIG. 6 is a plane view of the high frequency dielectric filter of FIGS. 4 and 5.
Figure 7:
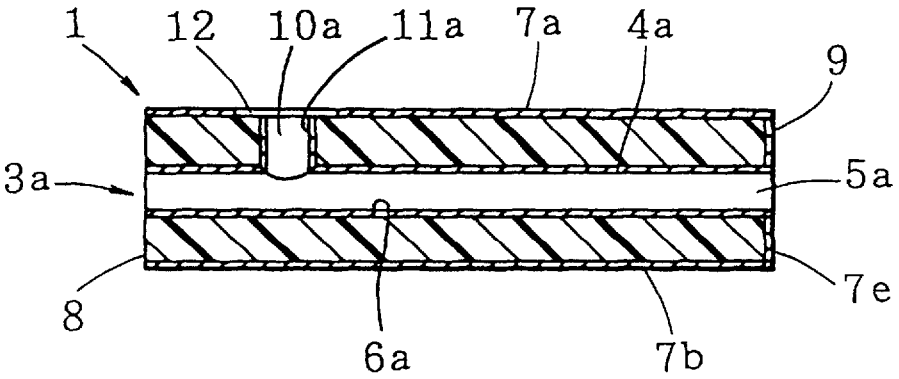
FIG. 7 is a longitudinal section showing the dielectric filter of FIG. 6 taken along line A—A.
Figure 8A:
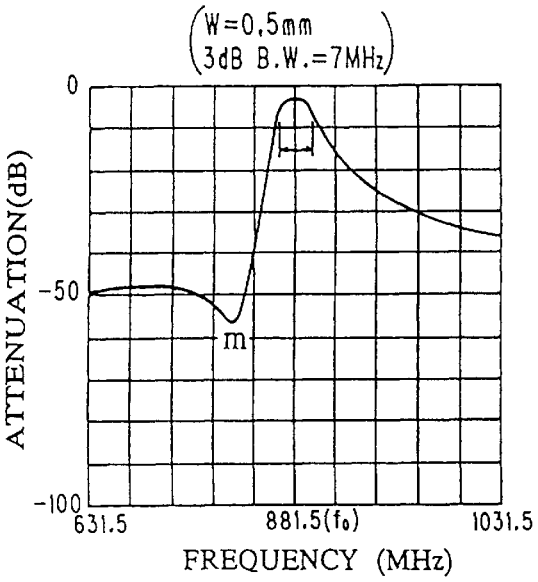
FIGS. 8*a,* 8*b,* 8*c* and 8*d* are graphs illustrating how the frequency characteristic of the dielectric filter shown in FIGS. 4 to 7 may be changed by varying the width of the connecting section, with each of the Figures showing the frequency characteristic for a different width.
Figure 8B:
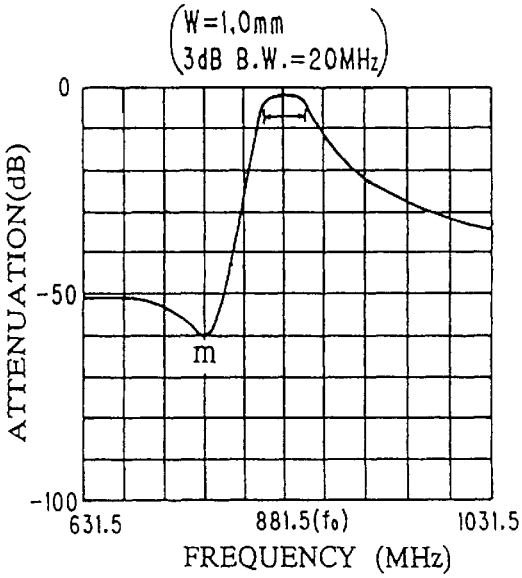
Figure 8C:
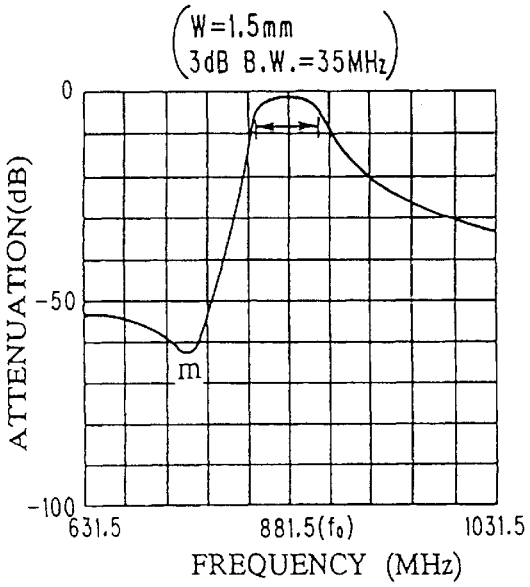
Figure 8D:
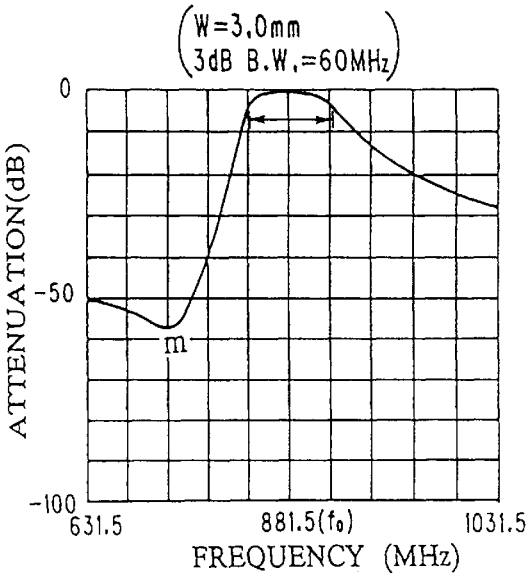

Each of the openings of the auxiliary through bores 10*a,* 10*b* and 10*c* on the top side surface of the block 2 is provided with an electrode cut-out section or electrically non-conductive section 12 (FIGS. 4, 6 and 7). More specifically, the auxiliary through bores 10*a,* 10*b* and 10*c* are located at positions separated from the open-circuit end surface 8 by a distance equal to ¼ of the resonance length. The non-conductive sections 12 of the auxiliary through bores 10*a,* 10*b* and 10*c* are annular and arranged coaxially with the respective auxiliary through bores.

Now, some of the principal sections of the dielectric filter of the present invention will be described in greater detail.

The non-conductive sections 12 arranged on the top side surface of the dielectric ceramic block 2 are connected by means of a strip-shaped non-conductive connecting section 13 (FIGS. 4 and 6) having a predetermined width. The strip-shaped connecting section 13 is provided by removing the shield electrode 7*a* along a straight line connecting the openings of the auxiliary through bores 10*a,* 10*b* and 10*c*. As will be described hereinafter, the frequency bandwidth of the dielectric filter is broadened by the connecting section 13.

Further, referring particularly to FIG. 5 the opposite lateral side or bottom side surface of the dielectric ceramic block 3 has the shield electrode 7*b* and a pair of input-output conductors 14*a* and 14*b* that are electrically insulated from the shield electrode 7*b*. The input-output conductor 14*a* is capacitively connected to the internal conductive film 6*a* of the resonant conductor 4*a* by way of the dielectric ceramic block 2, whereas the input-output conductor 14*b* is capacitively connected to the internal conductive film 6*c* of the resonant conductor 4*c*. Either one of the input-output conductors 14*a* and 14*b* is electrically connected to an input terminal of a given electric path, whereas the other input-output conductor is electrically connected to an output terminal of the electric path to establish a closed circuit incorporating the high frequency dielectric filter 1.

In an experiment carried out to produce a dielectric filter having a central frequency of about 881.5 MHz, a specific dielectric constant of 81 and outer dimensions of 8.5 mm (length)×7.5 mm (width)×2.5 mm (height) were selected for the dielectric ceramic block 2 and three resonant conductors 4*a,* 4*b* and 4*c* were formed therethrough to a diameter of 1 mm with an interval of 2 mm separating any two adjacent resonant conductors. Then, auxiliary through bores 10*a,* 10*b* and 10*c* each having a diameter of 1 mm were respectively formed at positions separated by 2.1 mm from the open-circuit end surface 8 and the openings of the auxiliary through bores 10*a,* 10*b* and 10*c* were provided with respective non-conductive sections 12 surrounding them and the non-conductive connecting section 13 for connecting the non-conductive sections 12. In this way, there were prepared several samples of dielectric filters in which the connecting section 13 is formed to have different widths W.

FIGS. 8(*a*), 8(*b*), 8(*c*) and 8(*d*) show the frequency-related attenuation characteristics of the prepared dielectric filters with different widths W of the connecting section 13.

As to the connecting section, as will be seen in FIG. 6, a straight line connecting and tangent to the upper ends of the non-conductive sections 12 is selected for a reference line L and a side line of the connecting section, and the width W of the connecting section 13 is defined by the distance of the other side line from this reference line.

Graphs (a) through (d) in FIG. 8 respectively represent the cases of widths of W=0.5 mm, W=1.0 mm, W=1.5 mm and W=3.0 mm. In the respective cases the outer diameter of the non-conductive sections 12 is equal to 3.0 mm. Thus, in the case (d) the connecting section 13 is produced by circumscribing the three non-conductive sections 12.

Figure 3:
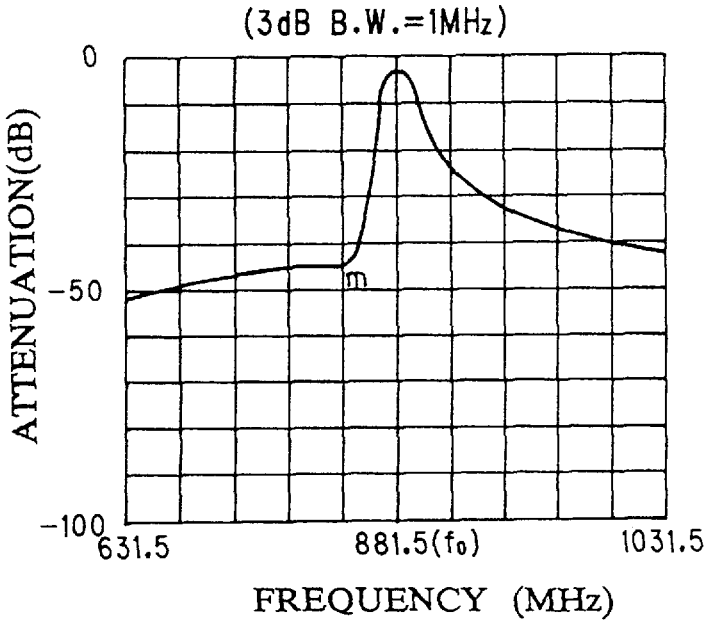
FIG.3 PRIOR ART
FIG. 3 is a graph illustrating the performance of the known dielectric filter having no connecting section as shown in FIG. 1.

By comparing the graphs (a) through (d) of of the known filter in FIG. 8 and that of FIG. 3, it will be seen that the attenuation pole m is moved further away from the center frequency on the lower frequency side by broadening the width W of the connecting section 13. The 3 dB frequency bandwidths (the frequency bandwidths at positions where the output is reduced by 3 dB from the output at the center frequency) of the samples are (a) 7 MHz, (b) 20 MHz, (c) 35 MHz and (d) 60 MHz respectively, whereas that of the conventional dielectric filter is 1 MHz.

Figure 9:
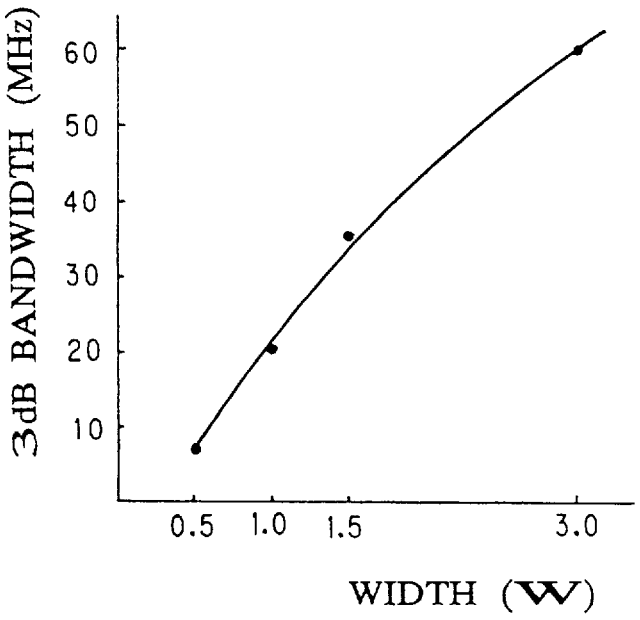
FIG. 9 is a graph illustrating the relationship between the width of the connecting section and the frequency bandwidth of the dielectric filter according to the invention.

FIG. 9 illustrates the relationship between the 3 dB frequency bandwidth (in MHz) and the width W of the connecting section 13, i.e., shows the effect of varying the width W on the bandwidth of the resonator.

Thus, the attenuation pole m is moved further away from the center frequency on the lower frequency side by broadening the width W of the connecting section 13 to produce a broad bandwidth. In other words, a dielectric filter having a broad frequency bandwidth can be realized by arranging a connecting section 13 on a comparable conventional dielectric filter having no connecting section. Additionally, a desired frequency bandwidth can be realized by regulating the width W of the connecting section 13.

While different widths W were used for the connecting section in the above embodiment, employing a line tangent to all the non-conductive sections 12 for a reference line L, the position of the reference line L was shifted therefrom in another embodiment.

Figure 10A:
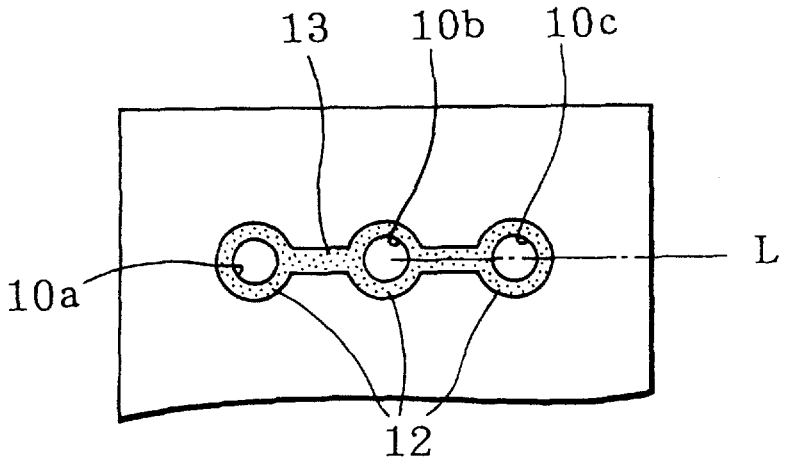
FIG. 10A is a partial front view of a high frequency dielectric filter according to another embodiment of the invention in which a connecting section is formed along a reference line connecting the centers of the auxiliary through bores.
Figure 10B:
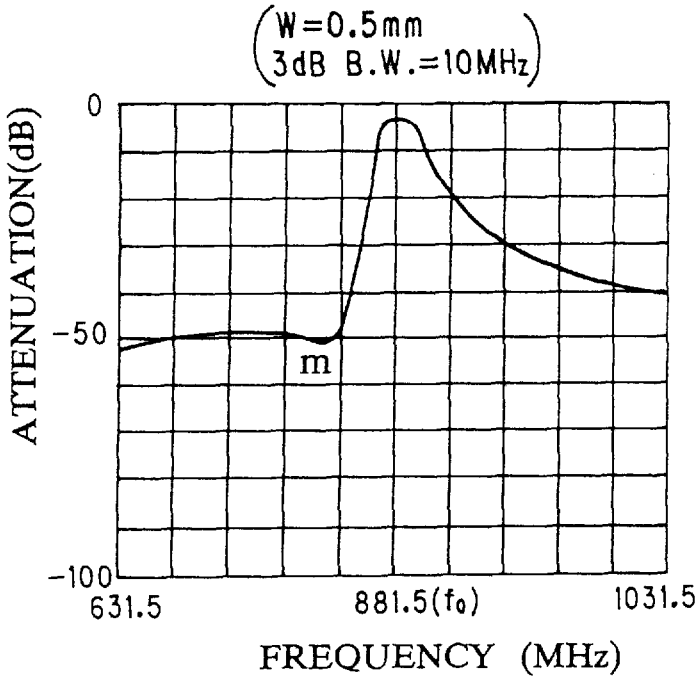
FIG. 10B is a graph illustrating the frequency characteristic of the dielectric filter of FIG. 10A.

FIG. 10A illustrates another embodiment of the present invention in which the reference line L is a straight line connecting the centers of the auxiliary through bores 10*a,* 10*b* and 10*c* and the width of the connecting section 13 between non-conductive sections 12 (corresponding to the width W of FIG. (6) is 0.5 mm. With this arrangement, as shown in FIG. 10B which a curve m represents the attenuation as a function of frequency, the 3 dB frequency bandwidth was 10 MHz.

Figure 11A:
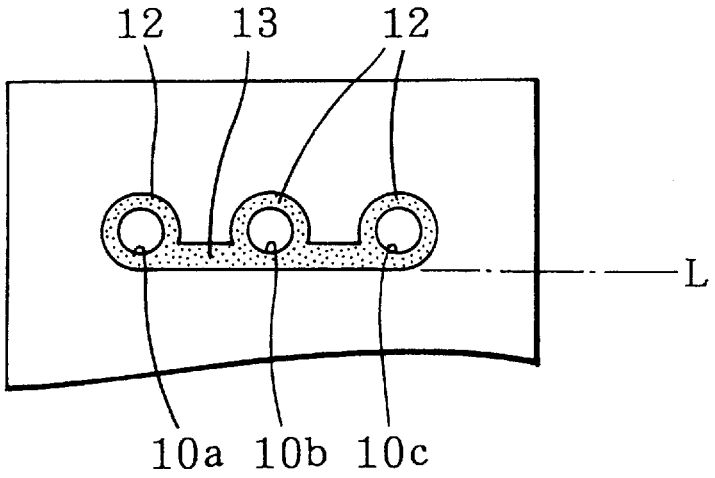
FIG. 11A is a partial front view of a high frequency dielectric filter according to a further embodiment of the invention in which a connecting section is formed along a reference line that is tangent to the lower ends of the non-conductive sections.
Figure 11B:
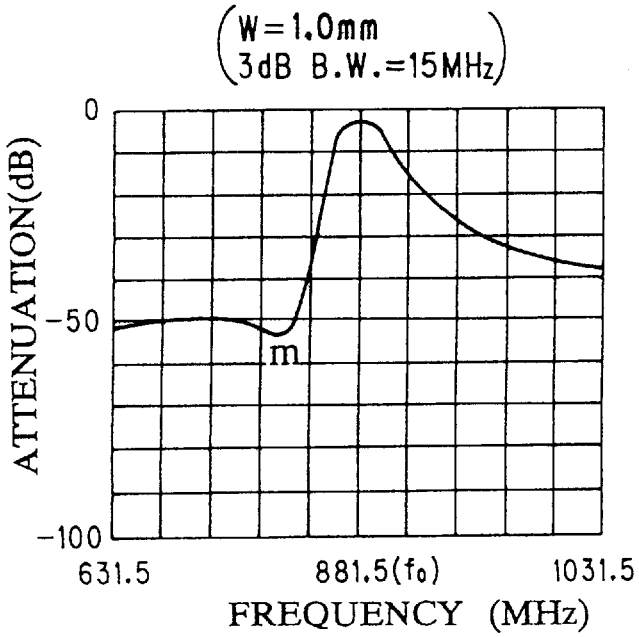
FIG. 11B is a graph illustrating the frequency characteristic of the dielectric filter of FIG. 11A.

FIG. 11A illustrates a further embodiment of the present invention in which the reference line L was a straight line connecting the lower edges of the auxiliary through bores 10*a,* 10*b* and 10*c* and the width W of the connecting section 13 between non-conductive Sections 12 (corresponding to the width W of FIG. 6) is 1.0 mm. With this arrangement, as shown in FIG. 11B, wherein a curve m represents the attenuation as a function of frequency, the 3 dB frequency bandwidth was 15 MHz.

From these observations, it will be understood that a broader frequency bandwidth can be obtained and a different frequency band can be produced by appropriately arranging a connecting section 13 on a dielectric filter of the type under consideration.

As seen from above, the frequency bandwidth can be broadened by using a wider connecting section 13. More specifically, by removing the shield electrode 7*a* between the openings of the auxiliary through bores 10*a,* 10*b* and 10*c,* the electric fields there are prevented from escaping so as to raise the intensity of electric field coupling there and establish the relationship that the electric field coupling is stronger than the magnetic field coupling to consequently realize an electric field coupling between any adjacent resonators. The degree of coupling can be regulated by appropriately removing the shield electrode 7*a* and increases proportionally with the width W of the connecting section 13. On the other hand, the attenuation pole m is defined by the relationship that the strength of the electric field coupling is equal to that of the magnetic field coupling. In other words, the attenuation pole m that satisfies the above relationship is moved away from the resonance frequency $f_o$ on the lower frequency side of the center frequency as the electric field coupling increases. Thus, as the attenuation pole m is moved away from the center frequency on the lower frequency side, the frequency characteristic having an apex at the resonance frequency $f_o$ is flattened to consequently broaden the frequency bandwidth of the dielectric filter.

Therefore, the frequency bandwidth can be optimized by regulating the width W of the connecting section 13, utilizing the above relationship.

Additionally, the regulating operation can be reproducibly standardized by selecting a reference line L for controlling the width W of the connecting section 13.

The connecting section 13 may be accurately formed on a dielectric filter of the type under consideration by patterning, using a screen printing technique, in an operation of simultaneously producing the shield electrode 7*a* and an electrically non-conductive region that makes the connecting section and the electrode cut-out sections. The connecting section 13 can be prepared very accurately by means of such a technique.

The connecting section 13 may alternatively and partly be prepared by forming shallow transversal slits in the shield electrode 7*a* provided on the dielectric ceramic block 2 by means of a dicing saw.

Still alternatively, the connecting section 13 may be prepared by forming such slits when producing the dielectric ceramic block 2 by press machining and then applying a conductive material to the surface of the dielectric ceramic block to produce conductive films so that the conductive material may not be applied to the slits.

The connecting section 13 may still alternatively be prepared by removing partially the shield electrode 7*a* after the formation of the shield electrode 7*a* by means of a laser trimmer or a sand blast.

Again, the frequency bandwidth or the attenuation pole producing frequency of a dielectric filter 1 having a configuration as described above can be regulated by controlling the width W of the connecting section 13. Therefore, whenever necessary, the performance or characteristic of the dielectric filter can be easily regulated by modifying the width W of the connecting section 13 by, for example, partly scraping off the shield electrode 7*a* around the connecting section 13 or, conversely, partly covering the connecting section 13 with conductive film to reduce the width W of the connecting section 13.

While all of the above described high frequency dielectric filters comprise three resonators, it will be understood that the present invention is equally applicable to high frequency dielectric filters having two, four or more than four resonators.

As described in the above, according to the invention, with the provision of the connecting section for connecting the non-conductive sections disposed around the respective openings of the auxiliary through bores 10*a,* 10*b* and 10*c* running perpendicularly from given positions of the through bores to the top side surface of the dielectric ceramic block, the attenuation pole m that is generated on lower frequency side of the center frequency can be moved away from the center frequency to flatten the resonance frequency characteristic at and near the center frequency and broaden the frequency bandwidth so that a dielectric filter having a wide frequency bandwidth can easily be realized.

Thus, the frequency bandwidth of a dielectric filter according to the invention can be regulated easily by controlling the width of the connecting section on the basis of the relationship that the frequency bandwidth is broadened by enlarging the width of the connecting section.

I claim:

1. A dielectric filter comprising:

a dielectric ceramic block of a rectangularly parallelepipedic shape having a first and second end surfaces and four lateral side surfaces extending between the first and second end surfaces, said second end surface and four lateral side surfaces being respectively substantially covered with a conductive layer which operates as a shield electrode;

at least two resonators disposed in parallel with each other within said dielectric ceramic block, each resonator comprising a through bore which extends from the first end surface to the second end surface of said dielectric ceramic block and an inner conductive layer provided on an inner surface thereof;

at least two auxiliary through bores each extending perpendicularly from a respective given position of the corresponding through bore of said associated resonator to one of said four lateral side surfaces and being provided with a respective inner conductive layer on an inner surface thereof, and each respective auxiliary through bore having an opening at said one lateral side surface of the block;

at least two electrically non-conductive sections arranged to surround the opening of said each auxiliary through bore on said one lateral side surface of the block; and an electrically non-conductive connecting section provided for connecting said electrically non-conductive sections to each other and extending between the adjacent openings of said auxiliary through bores.

2. A dielectric filter as claimed in claim 1, wherein said connecting section has a predetermined width and extends along a straight line connecting the adjacent openings of said auxiliary through bores.

3. A dielectric filter as claimed in claim 1, wherein the openings of said auxiliary through bores have centers and said connecting section has a predetermined width and extends along a straight line connecting the centers of the adjacent openings of said auxiliary through bores.

4. A dielectric filter as claimed in claim 1, wherein said at least two auxiliary through bores are located at positions separated from said first end surface by a distance equal to ¼ of a resonance length.

5. A dielectric filter as claimed in claim 1, wherein said connecting section comprises at least one slit in the shield electrode portion extending between the adjacent openings of said auxiliary through bores.

6. A method of regulating the frequency bandwidth of a dielectric filter comprising a dielectric ceramic block of a rectangularly parallelepipedic shape having a first and second end surfaces and four lateral side surfaces extending between said first and second end surfaces, said second end surface and four lateral side surfaces being respectively substantially covered with a conductive layer which operates as a shield electrode, at least two resonators being disposed in parallel with each other within said dielectric ceramic block, each of resonators comprising a through bore which extends from the first end surface to the second end surface of said dielectric ceramic block and an inner conductive layer provided on an inner surface of said through bore, at least two auxiliary through bores being provided to extend perpendicularly from a respective given position of the corresponding through bore of said associated resonator to one of said four lateral side surfaces of said block, each auxiliary through bore being provided with an inner conductive layer on an inner surface thereof and having an opening at said one lateral side surface of the block around which an electrically non-conductive section is arranged on said one lateral side surface of the block, the method comprising partially removing the shield electrode portion between the adjacent openings of said adjacent auxiliary through bores to form an electrically non-conductive connecting section for connecting the electrically non-conductive sections to each other, and setting a width of the electrically non-conductive connecting section so as to obtain a desire frequency bandwidth.

* * * * *